US005868249A

United States Patent [19]

Ehnert

[11] Patent Number: 5,868,249

[45] Date of Patent: Feb. 9, 1999

[54] DISPLAY CASE FOR SPORTS BALLS

[76] Inventor: Mark Ehnert, N71 W23225 Keystone Dr., Sussex, Wis. 53089

[21] Appl. No.: 882,023

[22] Filed: Jun. 25, 1997

[51] Int. Cl.[6] ..... B65D 85/00

[52] U.S. Cl. ..... 206/315.9; 206/579; 206/775

[58] Field of Search ..... 206/315.1, 315.9, 206/315.91, 525, 579, 583, 771, 775, 776; 220/324, 327; 99/421 H; 242/160.1, 160.3, 174; 312/135

[56] References Cited

U.S. PATENT DOCUMENTS

| | | | |
|---|---|---|---|
| D. 365,948 | 1/1996 | Borden . | |
| 2,120,826 | 6/1938 | Young . | |
| 2,928,537 | 3/1960 | Stagner | 206/493 |
| 2,963,147 | 12/1960 | Stagner | 206/525 |
| 3,231,993 | 2/1966 | Levy . | |
| 3,365,308 | 1/1968 | Janicke | 206/493 |
| 3,601,461 | 8/1971 | Melcher . | |
| 3,935,944 | 2/1976 | Wilson et al. | 206/776 |
| 5,082,110 | 1/1992 | Hager . | |
| 5,232,095 | 8/1993 | Childers et al. | 206/583 |
| 5,377,829 | 1/1995 | Bahl . | |
| 5,379,892 | 1/1995 | Reams et al. . | |

FOREIGN PATENT DOCUMENTS

| | | |
|---|---|---|
| 702014 | 1/1965 | Canada . |

*Primary Examiner*—Paul T. Sewell
*Assistant Examiner*—Luan K. Bui
*Attorney, Agent, or Firm*—Ryan Kromholz & Manion, S.C.

[57] ABSTRACT

An enclosed transparent display case for sports balls comprising a base section removably attached to rounded top section which incorporates rotatably affixed handle calipers to secure and suspend the sports ball within the display case. The display case provides the ability to suspend the ball within the interior of the display case and allow the ball to be rotatably controlled by a viewer and observe the ball with a clear view and a normal viewing angle without picking up the display or removing the ball.

20 Claims, 4 Drawing Sheets

DISPLAY CASE FOR SPORTS BALLS

BACKGROUND OF THE INVENTION

The present invention relates generally to the viewing and displaying of various sports balls such as basketballs, footballs, and baseballs, and in particular, to holding and securing such sports balls within a display case. More particularly, this invention relates to securing a sports ball within a viewing case and providing a means to definably rotate the ball within the display case to enhance visibility of the ball.

Standard display cases of all types generally comprise various protective enclosures to contain the item being displayed. These display cases are often constructed completely of a transparent material or a transparent window area is incorporated to allow viewing of the displayed item.

The function of a display case is to protect the displayed item from harmful external elements while retaining the ability to view and enjoy the item while it is enclosed. Displayed items are protected from the immediate harm caused by occurrences such as dropping or spilling material on to the item, as well as the harmful long-term effects of exposure to smoke and dust. This allows the condition and value of a displayed item to be maintained for a longer period of time than if unprotected.

Sports balls obtain their value and significance both financially as collectors items and as mementos based primarily upon the relation of the ball to a particularly significant game, specific player, or player signature(s) on the ball. In many instances, these factors can give a sports ball substantial financial value over the inherent value of the ball itself. Indeed, signed sports ball, or balls used in the winning score of a game or championship, have sold for thousands of times their inherent purchase price. Additionally, this value customarily increases over time. The function of a sports ball display case protects the condition of these value enhancing factors.

Because sports balls are predominately cylindrical in shape, sports ball display cases are either form-fit to the shape and size of the particular sports ball and secured to a flat base for stability, or they are rectangular in shape and the display is provided a stable base by one side of the case. In each method, the ball is staticly mounted or secured within the display.

While each of these methods provides protection to the ball, they can often limit visibility due to an opaque bottom secured to the base, or to the impaired visibility caused by viewing through the corner edges of a rectangular case made of transparent material. Therefore, to fully view the ball in most display cases the case must be picked up and removed from its base. Alternatively, a displayed ball must be removed from the display case entirely.

Picking up the display case risks dropping the case or dislodging the ball. Removing the ball from the display case subjects the surface of the ball, and any signatures on it, to oils from the skin. These oils can substantially tarnish the appearance of the ball and value of the ball. Because of this, it is desirable to permanently maintain the ball within the enclosure of the display case to avoid all contact.

While existing display cases provide the protection necessary to display valuable sports balls, they do not provide an easy method to fully, and safely, view the entire ball. The present invention provides a way to obtain the benefits of protection, and full visibility of the ball, without removing it from the display case or incurring the risk of dropping the display case itself.

The present invention comprises a secured transparent case with rotating calipers which suspend the ball within the interior of the display case and allow the ball to be rotatably controlled by a viewer. In this way, the present invention allows a viewer to observe the ball with a clear view and a normal viewing angle without the distortions that are caused by viewing through the square corners of transparent material.

SUMMARY OF THE INVENTION

The present invention comprises a securable transparent case which is used to store and display a variety of sports balls. The securable case utilizes two rotating calipers which protrude outside the case to rotatably secure and suspend the ball within the case. The ball is placed inside the case between two opposed calipers located at opposite ends of the case. The display case is properly sized to the specific size and type sport ball to be displayed. The width of the case, and the resulting distance between the opposed calipers, is sized slightly less than the width of the displayed ball to allow the ball to be inserted between the calipers in a deflated manner, and slightly inflated thereafter to appropriately fasten the ball within the case where the ball then remains only partially inflated while displayed.

The display case comprises a transparent rounded cover which is detachably affixed to a base that can placed on a flat surface or securely mounted to a wall in a horizontal or vertical position or under a shelf in a space saver fashion. The rounded transparent cover allows the displayed ball to be viewed from a wide range of angles without the distortion caused by the square or angled corners of an cube shaped case.

The display case comprises two primary embodiments, each using a securable transparent rounded cover which is detachably affixed to a base, each top with opposed rotatable calipers for securing the ball within the case. The different embodiments reflect the sizes and shapes of various sports balls.

The first embodiment comprises an elongated top and base used to display a football or rugby type shaped ball which is itself elongated. This elongated embodiment can comprise various lengths and sizes.

The second embodiment comprises a uniformly rounded cube shape used to display spherical sports balls such as basketballs, baseballs and soccer balls. This embodiment for spherical sports balls can also comprise various lengths and sizes.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
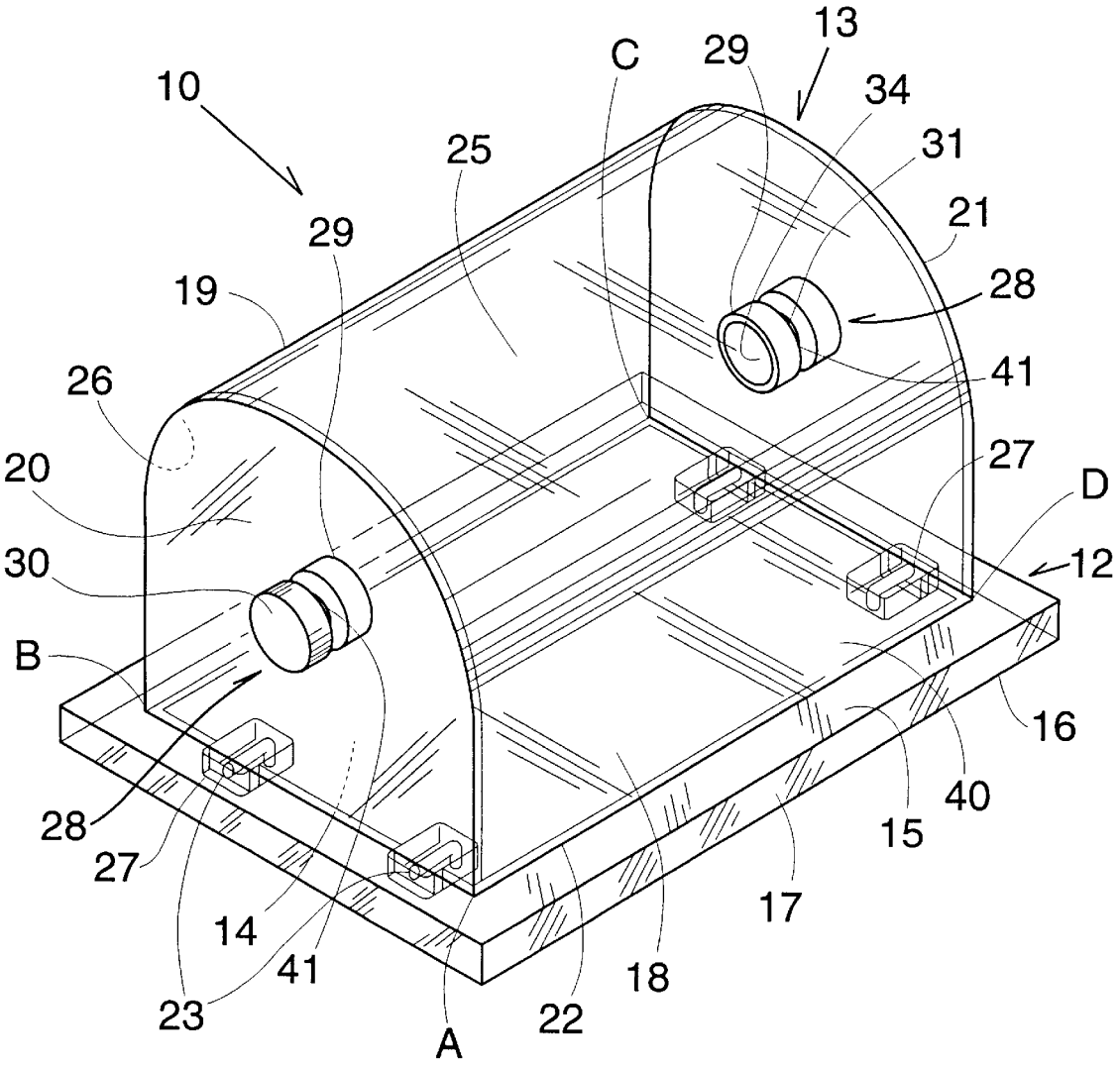
FIG. 1 is a top perspective of a first embodiment of the display case showing a top, a base, stay pegs, and caliper handles.
Figure 2:
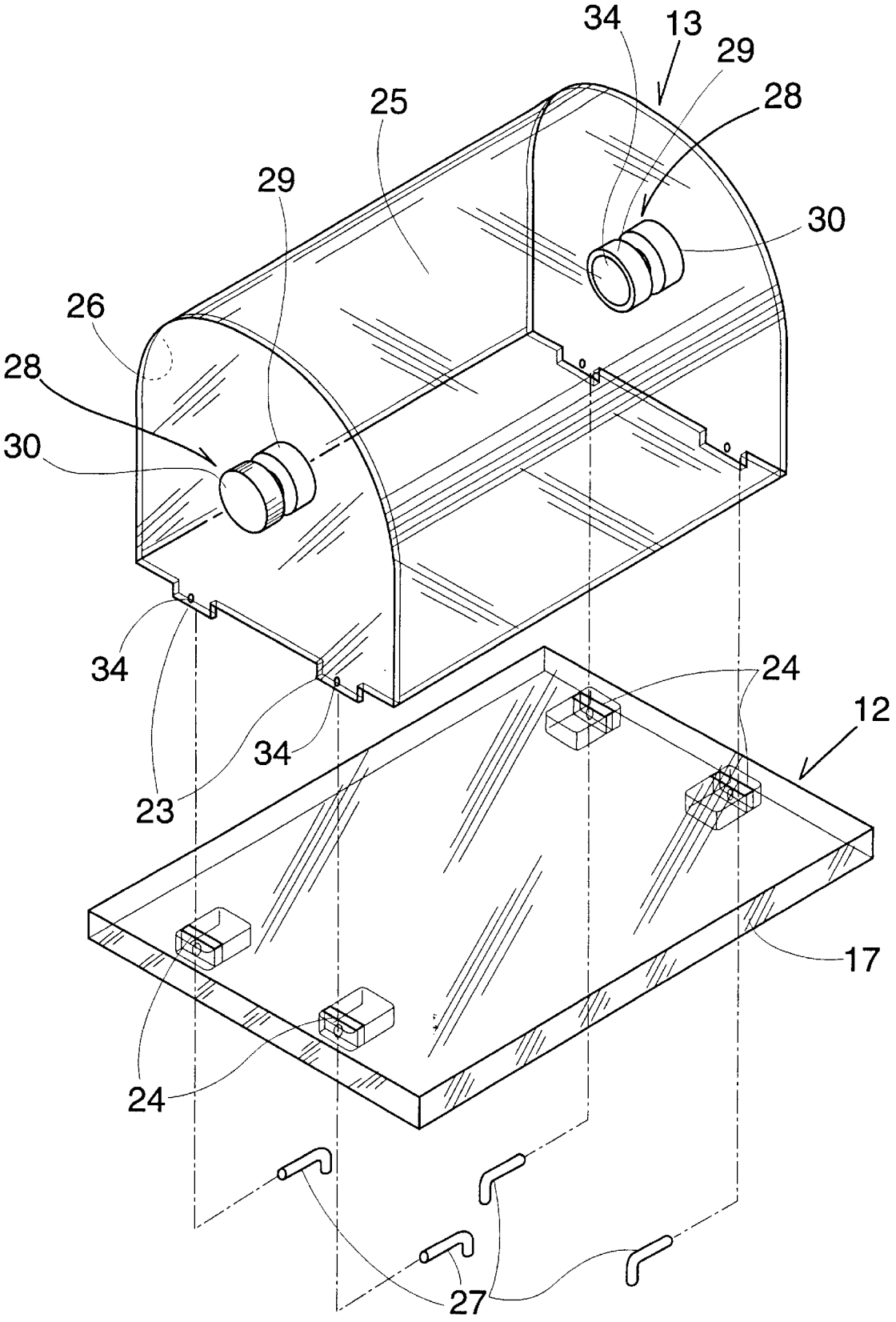
FIG. 2 is an exploded top perspective of FIG. 1 showing the based separated from the top of the case and stay pegs.

With reference to FIGS. 1 and 2, it will be noted the display case 10 of this invention comprises a securable enclosure made up of a base section 12, and a generally rounded top cover section 13, defining an interior region 14. The base section 12 is further characterized by having a top side 15, a bottom side 16, an edge 17, and index tab receptacles 24. The top cover section 13 is further characterized by having a front side 18, a back side 19, a left side 20, a right side 21, a bottom edge 22, index tabs 23 and index tab apertures 34. The top cover section 13 has an exterior surface 25 and an interior surface 26 and is removably attached to the top side 15 of the base section 12 by means of several removable stay pegs 27 positioned through the index tabs 23 of the top cover section 13 and the index tab receptacles 24 of the base section 12.

The preferred material of the curved top section 13 is ⅛ inch plastic having transparent properties, and 3/16 inch transparent plastic for the left side 20 and the right side 21, but it is to be understood that a variety of material may be used to accomplish the same desired function. The preferred construction used to permanently affix the top section 13 to the left 20 and right 21 sides is glue or UV chemical adhesive. But it is to be understood that a variety of construction methods or fabrications may be used to accomplish the same desired functions.

Figures 6A, 6B:
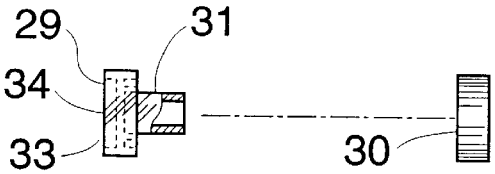
FIG. 6A is an enlarged partially cut-away plan view of the interior portion of the caliper handle device showing the caliper and axis shaft.
FIG. 6B is an enlarged cut-away view of the exterior portion of the caliper handle device showing the handgrip.
Figure 7:
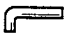
FIG. 7 is an enlarged view of a removable stay peg.

The preferred materials used to construct the base section 12 is pressboard, wood, plastic, Plexiglas, or acrylic. It is preferred that the top side 15 of the base section 12 be covered with a mirror 40 to visually enhance the view of the ball being displayed, or by an artificial turf material (not shown), or tapestry (not shown) to represent the sport arena, or field, upon which the particular sport is played. But it is to be understood that a variety of decorative materials may be used to enhance With additional reference to FIG. 1, contained within the left side 20 and the right side 21 of the top cover section 13 is a caliper handle device 28 comprised of a handgrip 30 positioned exterior to the surface 25 of the left 20 and right sides 21 and a caliper 29 extending into the interior region 14 of the top section 13 of the display case 10. With additional reference to FIGS. 6A and 6B, the caliper handle device 28 is further characterized by a circular handgrip 30 which slideably receives, and becomes pressure fitted to, a hollow shaft 31 connected to the caliper 29. The hollow shaft 31 of each caliper handle device 28 being rotatably secured within the right 20 and left 21 sides of the top cover section 13. The caliper 29 is further characterized by having a raised corner edge 33 which creates a recessed cavity region 34 used to hold the surface of a sports ball (not shown) within interior region 14 of the display case 10.

Referring generally to FIGS. 1–4, the left 20 and right 21 sides each have an aperture 41 through which the hollow shaft 31 of the handle caliper device 28 is received. The aperture 41 is sized to rotatably receive and secure the hollow shaft 31 of the handle caliper device.

With reference to FIG. 1, the display case 10 is shown in a closed position with the top cover section 13 secured against the base section 12 around the perimeter ABCD of the bottom edge 22 of the base section 12. When closed, the index tabs 23 of the top cover section 13 are fastened within one index tab receptacle 24 in the base section 12 by a removable stay peg 27, the stay peg 27 being inserted into the index tab aperture 24.

Referring generally to FIG. 2, the display case 10 is shown in an open position with the index tabs 23 and index tab apertures 24 shown more clearly extending downward from the bottom edge 22 of the top cover section 13. Shown also are the index tab receptacles 24 in the base section 12.

Figure 3:
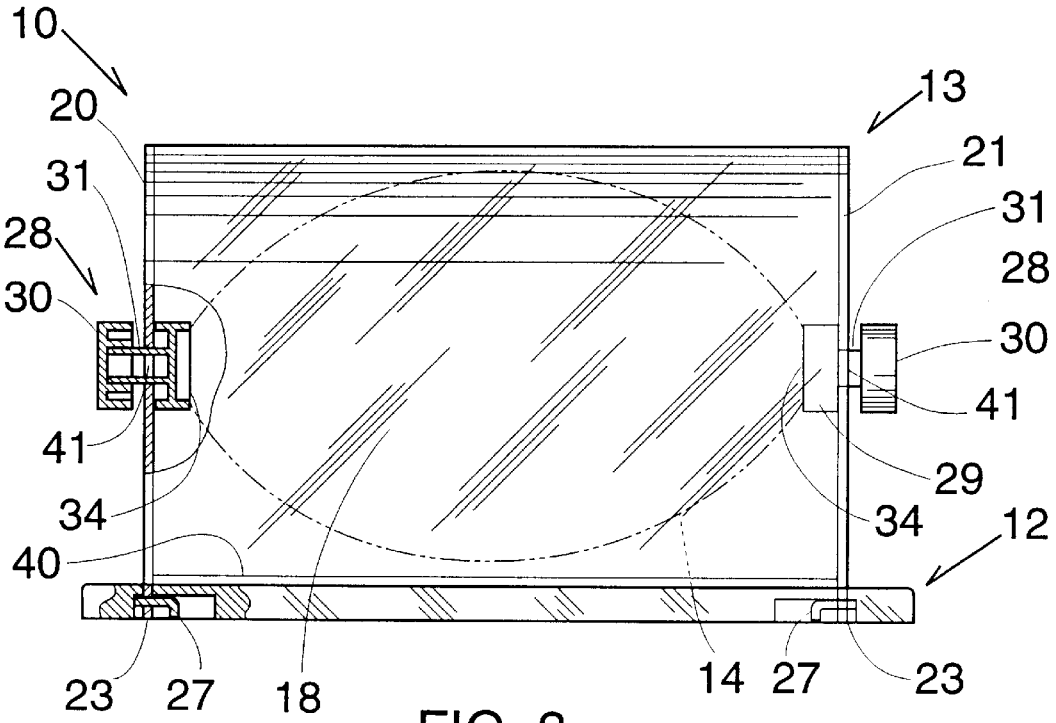
FIG. 3 is a front elevational view of an embodiment of the display case with an elongated shaped sports ball position therewithin in phantom between the caliper handles.
Figure 4:
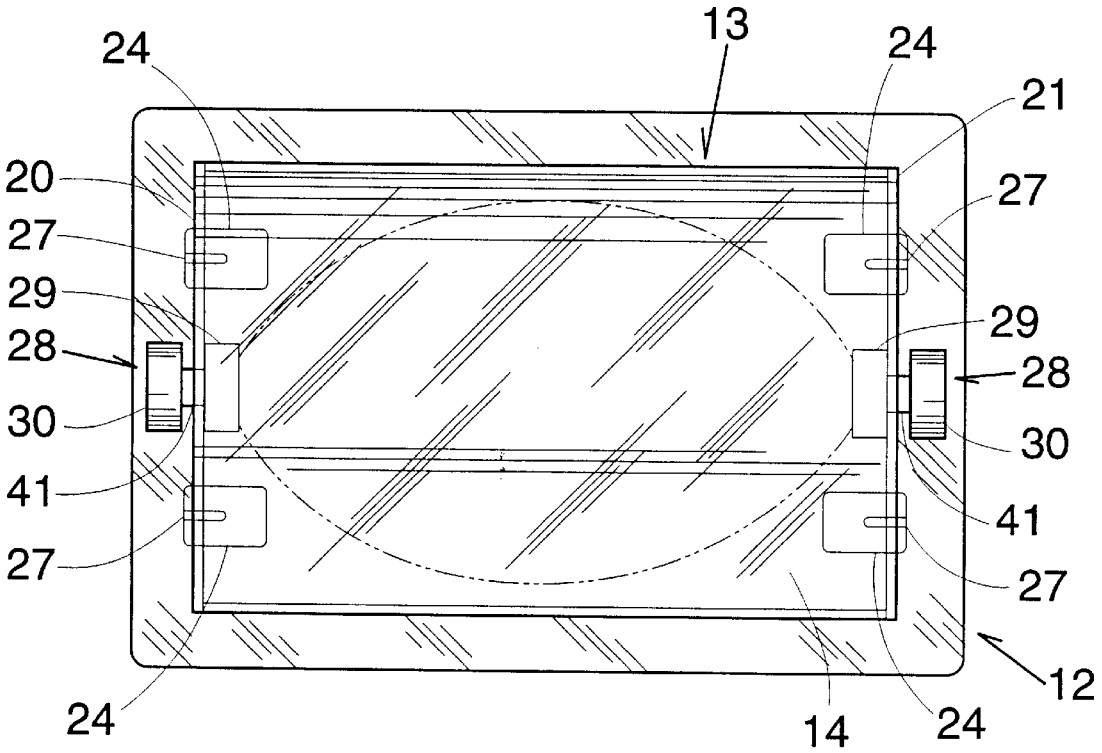
FIG. 4 is a top plan view of FIG. 3.
Figure 5:
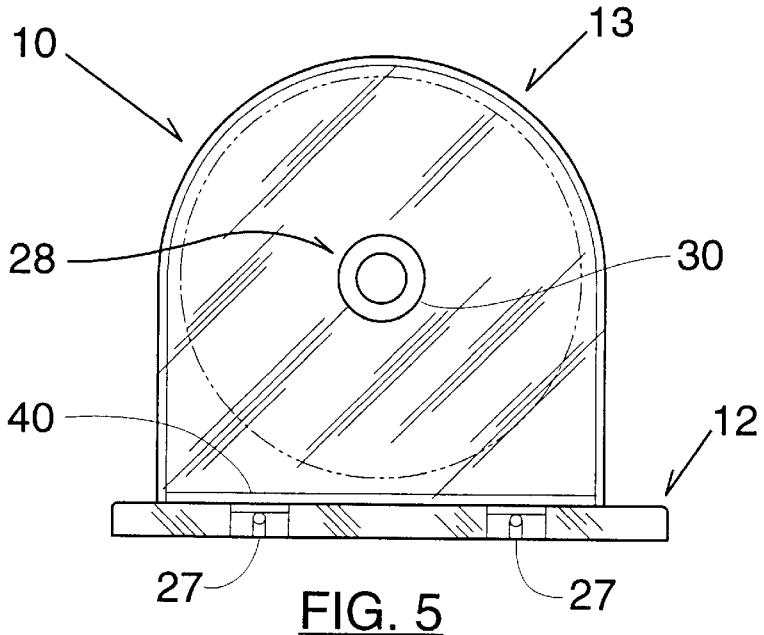
FIG. 5 is a side elevational view of a second embodiment of the display case showing the top member and the base member with a spherical sports ball enclosed therein in phantom.
Figure 8:
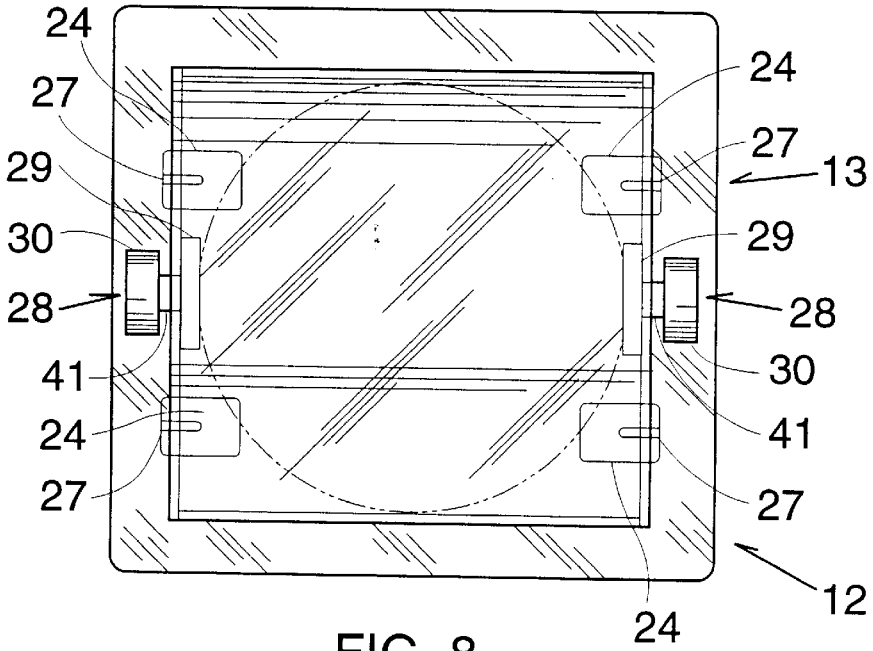
FIG. 8 is a top plan view of FIG. 5 showing the calipers holding the sports ball in phantom.

Referring now to the interior region 14 of the display case 10, as shown in FIGS. 3 and 4, an elongated sports ball is shown in phantom between the two opposed calipers 29. Similarly, FIGS. 5 and 8 show a spherical sports ball in phantom held between the two opposed calipers 29.

In use, the removable stay pegs 27 securing the top cover section 13 to the base section 12 are removed and the interior region 14 is exposed by lifting the top cover section 13 and index tabs 23 upward. Then, a sports ball (shown in phantom) is placed within the interior region 14 of the top cover section 13 in a semi-deflated manner such that the ends or sides of the sports ball (shown in phantom) are fittingly received within the recessed cavity regions 34 of the raised corner edge 33 of the opposed calipers 29. Thereafter, the sportsball is expanded by marginally inflating it to create a frictional cohesion between the surfaces of the sportsball and the caliper to secure and suspend the ball within the display case 10.

The top cover section 13 is then closed by placing the index tabs 23 into the index tab receptacles 24 and fastening the index tabs 23 to the base section 12 by securing the removable stay pegs 27 into the index tab apertures 34. The display case 10 is next placed on a desk (not shown) or secured to a wall (not shown) to provide visibility and access to the display case 10. Alternatively, the display case 10 may be mounted under a shelf in a space saver fashion. Thereafter, the handgrip 30 of the handle caliper device 28 is rotated in either direction to affect the rotation, and therefore enhanced visibility, of the sports ball as needed.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A display case for clearly and rotatably displaying a sports ball within a stationary secured enclosure at a determinable angle, the display case comprising:

a base section;

a transparent top enclosure section having opposed planar side sections, a front side and a back side, said top enclosure section being rounded from the front side to the back side and being positioned over said base section;

the opposed side sections each having a top and a bottom;

an aperture formed within each side section between the top and the bottom; and at least one handle caliper device, the handle caliper device being rotatably mounted through at least one of said apertures.

2. The display case of claim 1, wherein said transparent top enclosure section includes a front side, a back side, a right side, a left side, and a bottom edge; and a plurality of index tabs connected to said bottom edge.

3. The display case of claim 2, wherein said apertures are formed in a central portion of said right and left sides.

4. The display case of claim 2, wherein four index tabs are attached to the bottom edge of said top enclosure section.

5. The display case of claim 1, wherein said base section comprises a rectangular planar piece of material having a plurality of index tab receptacles formed therein.

6. The display case of claim 1, wherein said base section is removably attached to said top enclosure section.

7. The display case of claim 3, wherein said apertures are sized to rotationally support the handle caliper device therethrough.

8. The display case of claim 7, wherein said handle caliper device comprises a handgrip and a caliper, the handgrip being removably attached to the caliper.

9. The display case of claim 8, wherein said caliper has a recessed cavity region surface area formed on one side.

10. The display case of claim 4 further including at least one stay peg; and at least one of said index tabs having a stay peg aperture formed therein, said stay peg aperture for receiving said stay peg.

11. The display case of claim 7, wherein said handle caliper device is rotateably secured within said aperture.

12. A display case for clearly and rotatably displaying the full surface of a sports ball within a stationary secured enclosure at a determinable angle, the display case comprising:

a top cover section having a right planar side, a left planar side, a front side and a back side, the top cover section being rounded from the front side to the back side;

a base section, the top cover section being positioned over the base section;

an aperture formed within the right side and within the left side between the front side and back side of the top cover section;

two handle caliper devices, one handle caliper device being rotatably supported within said left side aperture and one handle caliper device being rotatably supported within said right side aperture; and each caliper device having a recessed cavity region for receiving the sports ball.

13. The display case of claim 12, wherein said top cover section and said right and left sides comprises a transparent material.

14. The display case of claim 12, further including a plurality of index tabs, said index tabs being located along a bottom edge of said top cover section.

15. The display case of claim 12, wherein said right and left side apertures are centrally located within said right and left sides.

16. The display case of claim 12, wherein said handle caliper device comprises a handgrip and a caliper, the handgrip being removably attached to said caliper.

17. The handle caliper device of claim 16, wherein said caliper is slidably received and pressured fitted within said handgrip.

18. The display case of claim 12, wherein said base section includes a top side, a bottom side, and an edge.

19. The display case of claim 18 further including a mirror, said mirror located on the top side of said base section.

20. The display case of claim 18 further including a tapestry, said tapestry located on the top side of said base section.

* * * * *